US005458068A

United States Patent [19]

Kilpatrick et al.

[11] Patent Number: 5,458,068

[45] Date of Patent: Oct. 17, 1995

[54] PALLET HAVING NOTCHED STRINGER AND NOTCHED BRACE

[75] Inventors: Ted D. Kilpatrick, Ponte Vedra Beach, Fla.; Arthur M. Wagner, Geneva, Ill.

[73] Assignee: Jefferson Smurfit Corporation (U.S.), St. Louis, Mo.

[21] Appl. No.: 285,660

[22] Filed: Aug. 3, 1994

Related U.S. Application Data

[63] Continuation-in-part of Ser. No. 201,345, Feb. 2, 1994, Pat. No. 5,427,034, which is a continuation-in-part of Ser. No. 74,942, Jun. 10, 1993, Pat. No. 5,370,061.

[51] Int. Cl.[6] ..... B65D 19/00

[52] U.S. Cl. ..... 108/51.3; 108/56.1

[58] Field of Search ..... 108/51.3, 51.1, 108/56.1

[56] References Cited

U.S. PATENT DOCUMENTS

| | | | |
|---|---|---|---|
| 2,446,914 | 8/1948 | Fallert et al. . | |
| 2,728,545 | 12/1955 | Hermitage . | |
| 2,955,791 | 10/1960 | George . | |
| 3,131,656 | 5/1964 | Houle . | |
| 3,165,078 | 1/1965 | White . | |
| 3,683,822 | 8/1972 | Roberts et al. . | |
| 4,792,325 | 12/1988 | Schmidtke . | |
| 4,867,074 | 9/1989 | Quasnick . | |
| 4,979,446 | 12/1990 | Winebarger . | |
| 5,001,991 | 3/1991 | Smith . | |
| 5,218,913 | 6/1993 | Winebarger et al. . | |
| 5,339,746 | 8/1994 | Vannatta | 108/51.3 X |
| 5,365,857 | 11/1994 | Kilpatrick et al. | 108/51.3 |
| 5,370,061 | 12/1994 | Kilpatrick et al. | 108/51.3 |
| 5,406,892 | 4/1995 | Kilpatrick et al. | 108/51.3 |

FOREIGN PATENT DOCUMENTS

| | | |
|---|---|---|
| 1250352 | 4/1968 | Germany . |
| 996516 | 7/1965 | United Kingdom . |

*Primary Examiner*—José V. Chen

*Attorney, Agent, or Firm*—Dressler, Goldsmith, Shore & Milnamow, Ltd.

[57] ABSTRACT

In a pallet, each of a plurality of similar stringers is folded from a single sheet of paperboard material and has at least two downwardly opening notches, and each of a plurality of similar braces is folded from a single sheet of paperboard material and has an upwardly opening notch. The upwardly opening notch of each brace is interengaged with one of the downwardly opening notches of the stringers, except that at least one of the stringers is not interengaged with such a brace at one or more of the downwardly opening notches. Each downwardly opening notch of each stringer is shaped so as to be deeper at the outer panels of such stringer and so and to so as to be shallower at two inner panels of such stringer. Each upwardly opening notch of each brace is shaped so as to interengage with such a notch of one of the stringers and so as to have a groove receiving portions of the inner panels of the stringer having the interengaging notch. The stringers and the braces are secured adhesively to one another at the interengaging notches.

9 Claims, 1 Drawing Sheet

PALLET HAVING NOTCHED STRINGER AND NOTCHED BRACE

CROSS-REFERENCE TO RELATED APPLICATIONS

This application is a continuation-in-part of U.S. patent application Ser. No. 08/201,345, which was filed on Feb. 2, 1994, now U.S. Pat. No. 5,427,034 which is assigned commonly herewith, and the disclosure of which is incorporated herein by reference. U.S. patent application Ser. No. 08/201,345 is a continuation-in-part of U.S. patent application Ser. No. 08/074,942, which was filed on Jun. 10, 1993, now U.S. Pat. No. 5,370,061 and the disclosure of which is incorporated herein by reference.

TECHNICAL FIELD OF THE INVENTION

This invention pertains to a pallet that may be predominantly made of paperboard material, such as corrugated paperboard, and comprising a longitudinally extending stringer folded from a single sheet of such material and a transversely extending brace folded from a single sheet of such material. The stringer and the brace have interengaging notches, which are shaped as described below, so as to strengthen the pallet and so as to improve its lateral stability.

BACKGROUND OF THE INVENTION

Usage of shipping pallets made predominantly of corrugated paperboard material is widespread, primarily because of their low cost, recyclability, and cleanliness. Typically, such pallets employ longitudinally extending, transversely spaced stringers, which are made from folded pieces of corrugated paperboard. Such pallets also may employ transversely extending, longitudinally spaced decking members, which also are made from folded pieces of corrugated paperboard.

As described above, shipping pallets made predominantly of paperboard material, such as corrugated paperboard, are exemplified in Schmidtke U.S. Pat. No. 4,792,325, Quasnick U.S. Pat. No. 4,867,074, and Smith U.S. Pat. No. 5,001,991. Similar pallets made predominantly of corrugated paperboard are available commercially from Gate Pallet Systems, Inc. of Crown Point, Ind., under its PAYLOAD trademark.

Other pallets of related interest are disclosed in Hermitage U.S. Pat. No. 2,728,545, Houle U.S. Pat. No. 3,131,656, Gifford U.S. Pat. No. 3,464,371, Childs U.S. Pat. No. 3,659,534, Roberts U.S. Pat. No. 3,683,822, Melli U.S. Pat. No. 4,563,377, British Patent Specification No. 996,516, German Patent No. 1,250,352, and Swiss Patent No. 512, 367.

As disclosed in Smith U.S. Pat. No. 5,001,991, it is known to increase the lateral stability and load-carrying capacity of such a pallet by means of tubular reinforcing pieces, which have slots interengaging with slots in the stringers. It is disclosed therein that tightly wound paper tubing, such as that used for cores for paper rolls, is a suitable material for such pieces.

In U.S. patent application Ser. No. 08/074,942, supra, several embodiments of an improved pallet are disclosed, in which at least one longitudinally extending stringer and at least one transversely extending brace are employed in a novel combination. As disclosed therein, a notch in the stringer interengages with a notch in the brace, and the notches are dimensioned so that the stringer and the brace are substantially coplanar at their upper and lower edges. Each embodiment of the improved pallet, as disclosed therein, is noteworthy for its lateral stability and load-carrying capacity.

In U.S. patent application Ser. No. 08/201,345, supra, two embodiments of a further improved pallet are disclosed. As disclosed therein, each brace has a generally planar upper edge, which may be adhesively secured to a generally planar lower edge of a decking member. Each embodiment of the further improved pallet, as disclosed therein, exhibits improvements in its lateral stability and load-carrying capacity.

This invention has resulted from efforts further to increase the lateral stability and load-carrying capacity of a shipping pallet that may be predominantly made of paperboard material.

SUMMARY OF THE INVENTION

This invention provides a pallet comprising at least two members, namely a longitudinally extending stringer folded from a single sheet of paperboard material and a transversely extending brace folded from a single sheet of paperboard material. The stringer and the brace have interengaging notches, which are shaped as described below, so as to strengthen the pallet and so as to improve its lateral stability.

The stringer is folded so as to have a lower panel having two outer edges, generally upright panels including two outer panels each extending upwardly from one of the outer edges of the lower panel and each having an upper edge, two upper panels each extending inwardly from the upper edge of one of the outer panels and each having an inner edge, and two inner panels secured adhesively to one another and each extending downwardly from the inner edge of one of the upper panels, approximately to the lower panel. The brace is folded so as to have an upper panel having two outer edges, two outer panels each extending downwardly from one of the outer edges of the lower panel and each having a lower edge, two lower panels each extending inwardly from a lower edge of one of the outer panels, and two inner panels adjacent to each other and each extending upwardly from an edge of one of the lower panels, approximately to the upper panel.

The stringer has a downwardly opening notch receiving a portion of the brace. The brace has an upwardly opening notch receiving a portion of the stringer. The downwardly and upwardly opening notches are interengaged with each other. As described so far, the pallet is similar to pallets disclosed in U.S. patent application Ser. No. 08/074,942, supra, and in U.S. patent application Ser. No. 08/201,345, supra.

In accordance with this invention, a notch selected from the downwardly and upwardly opening notches is shaped so as to be shallower at the inner panels of whichever of the stringer and the brace has the selected notch and so as to be deeper at the other generally uprights panels of whichever of the stringer and the brace has the selected notch. Moreover, the other notch is shaped so as to interengage with the selected notch. Furthermore, the stringer and the brace are secured adhesively to each other at the interengaging notches.

Preferably, the other notch is shaped so as to have a groove receiving portions of the inner panels of whichever of the stringer and the brace has the selected notch, where the selected notch is shallower. Preferably, the portions received by the groove are secured adhesively to whichever of the stringer and the brace has the notch having the groove, along and within the groove.

Desirably, the stringer has the selected notch and the brace has the other notch. Thus, where the selected notch is shallower, the stringer is strengthened by a web formed by the inner panels that are secured adhesively to each other. Also, if the stringer is one of a plurality of similar stringers of the pallet and if at least one of the stringers has at least one such downwardly opening notch that is not interengaged with the upwardly opening notch of such a brace, the last-mentioned stringer is strengthened by such a web at the downwardly opening notch that is not interengaged.

In one contemplated embodiment of this invention, the stringer is one of three similar stringers of the pallet, namely two outer stringers and a middle stringer. Further, each of the outer and middle stringers has two such downwardly opening notches spaced longitudinally from each other. Moreover, the brace is one of four similar braces of the pallet, and the upwardly opening notch of each brace is interengaged with one of the downwardly opening notches of the outer stringers. Furthermore, each of the downwardly opening notches of the middle stringer is not interengaged with the upwardly opening notch of such a brace.

Each brace may be advantageously folded so as to have a smaller cross-section, as compared to the cross-section of each stringer, if the lower panels of the stringers and the lower panels of the braces are coplanar so that the braces augment the lateral stability of the pallet. Thus, if the pallet further comprises a plurality of decking members extending transversely through apertures in the stringers with each decking member having a lower edge, the upper panel of each brace may be adjacent to the lower edge of one of the decking members. Also, the upper panel of each brace may be secured adhesively to the lower edge of one of the decking members.

These and other objects, features, and advantages of this invention are evident from the following description of a preferred embodiment of this invention with reference to the accompanying drawings.

DETAILED DESCRIPTION OF THE PREFERRED EMBODIMENT

Figure 1:
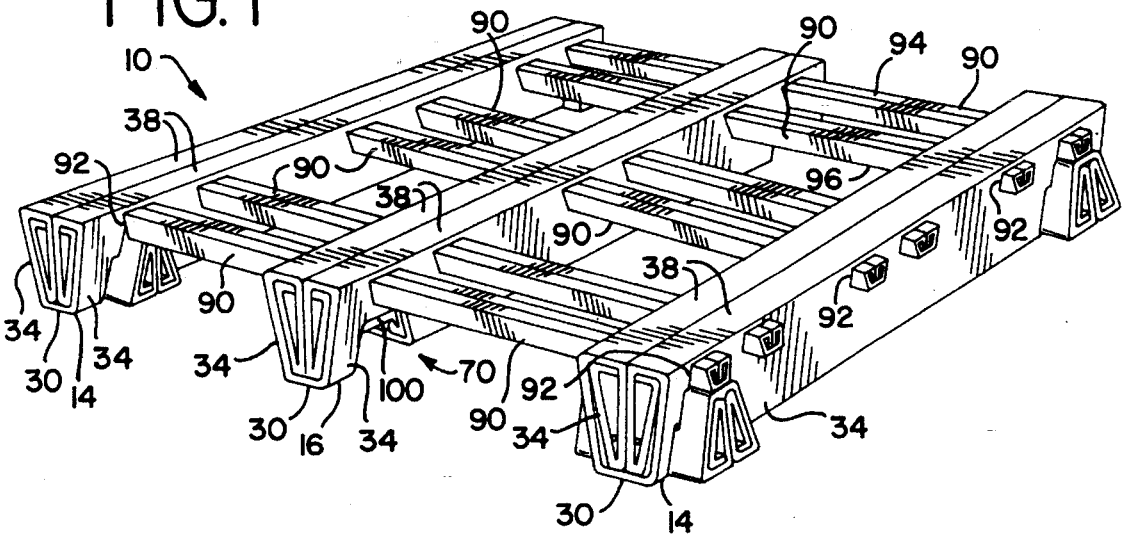
FIG. 1 is a perspective view of a predominantly paperboard pallet comprising three similar stringers, four similar braces, and three pairs of similar decking members and constituting preferred embodiment of this invention.

As shown in FIG. 1, a pallet 10 made predominantly of corrugated paperboard constitutes a preferred embodiment of this invention. The pallet 10 comprises three relatively long, longitudinally extending stringers, namely a middle stringer 12 and two outer stringers 14. The pallet 10 further comprises four relatively short, transversely extending braces 16, which brace the outer stringers 14. The braces 16 are arranged in two transversely aligned pairs, near the ends of the outer stringers 14.

Each of the stringers 12, 14, is folded from a single sheet of paperboard material so as to have a downwardly tapering, trapezoidal cross-section. The trapezoidal cross-sections of the stringers 12, 14, are substantially identical. Each of the braces 16 is folded from a single sheet of paperboard material so as to have an upwardly tapering, trapezoidal cross-section, which is substantially similar to the trapezoidal cross-section of each of the stringers 12, 14, but which is smaller as compared to the trapezoidal cross-section thereof, and which is inverted as compared thereto.

As shown, in each of the stringers 12, 14, and in each of the braces 16, eleven panels define a trapezoidal cross-section conforming to the trapezoidal cross-section of the improved stringer illustrated and described in a copending patent application, U.S. patent application Ser. No. 08/038,001 filed Mar. 29, 1993, and assigned commonly herewith, except that the trapezoidal cross-section of each of the braces 16 is smaller and is inverted, as compared to the trapezoidal cross-section of each of the stringers 12, 14. The disclosure of the copending patent application, U.S. patent application Ser. No. 08/038,001, is incorporated herein by reference. As disclosed in the copending patent application, U.S. patent application Ser. No. 08/038,001, certain of the folded panels are secured adhesively to other panels.

Alternatively, in each of the stringers 12, 14, and in each of the braces 16, eleven panels define a trapezoidal cross-section conforming to the trapezoidal cross-section of the improved stringer illustrated and described in a copending patent application, U.S. patent application Ser. No. 08/195,543 filed Feb. 14, 1994, and assigned commonly herewith, except that the trapezoidal cross-section of each of the braces 16 is smaller and is inverted, as compared to the trapezoidal cross-section of each of the stringers 12, 14. The disclosure of the copending patent application, U.S. patent application Ser. No. 08/195,543, is incorporated herein by reference. As disclosed in the copending patent application, U.S. patent application Ser. No. 08/195,543, certain of the folded panels are secured adhesively to other panels.

Alternatively, each of the stringers 12, 14, and each of the braces 16 may conform in their cross-sections to the trapezoidal cross-section of the pallet stringer disclosed in Quasnick U.S. Pat. No. 4,867,074, except that the trapezoidal cross-section of each of the braces 16 is smaller and is inverted, as compared to the trapezoidal cross-section of each of the stringers 12, 14. The disclosure of Quasnick U.S. Pat. No. 4,867,074 also is incorporated herein by reference.

In any event, each of the stringers 12, 14, is folded so as to have a lower panel 30 having two outer edges 32, two generally upright, outer panels 34, each extending upwardly and outwardly from one of the outer edges 32 and each having an upper edge 36, two upper panels 38, each extending inwardly from the upper edge 36 of one of the outer panels 34 and each having an inner edge 40, and two generally upright, inner panels 42, each extending downwardly from the inner edge 40 of one of the upper panels 38, approximately to the lower panel 30. The inner panels 38 are secured adhesively to each other, substantially across their widths and substantially across their lengths. Each stringer 12, 14, has other inner panels including two other generally upright panels 44 for reinforcing and bracing such stringer 12, 14.

In any event, each of the braces 16 is folded so as to have an upper panel 50 having two outer edges 52, two generally upright, outer panels 54, each extending downwardly and outwardly from one of the outer edges 52 and each having an lower edge 56, two lower panels 58, each extending inwardly from the lower edge 56 of one of the outer panels 54 and each having an inner edge 60, and two generally upright, inner panels 62, each extending upwardly from the inner edge 60 of one of the upper panels 58, approximately to the upper panel 50. The inner panels 62 are secured adhesively to each other, substantially across their widths and substantially across their lengths. Each brace 16 has other inner panels including other two other generally upright panels 64 for reinforcing and bracing such brace 16.

Each of the stringers 12, 14, has two longitudinally spaced, downwardly opening, downwardly flaring notches 70. Each of the notches 70 of each of the outer stringers 14 receives a lower portion 72 of one of the braces 16. Each of the notches 70 of the middle stringer 12 does not receive such a portion of such a brace. Each of the braces 16 has an upwardly opening, upwardly flaring notch 80, which receives an upper portion 82 of one of the outer stringers 12. Thus, each of the downwardly opening notches 70 of each of the outer stringers 14 and each of the upwardly opening notches 80 of the braces 16 are interengaged with each other. Also, the outer stringers 14 are secured adhesively to the braces 16 at the interengaging notches 70, 80.

The pallet 10 further comprises three pairs of similar decking members 90, which extend transversely through apertures 92 in the stringers 12, 14. The decking members 90 are secured adhesively to the stringers 12, 14, at margins of the apertures 92. Each decking member 90 is folded from a single sheet of paperboard material, such as the material used for the stringers 12, 14, so as to have multiple panels, some of which panels are secured adhesively to other panels of such decking member 90. Each decking member 90 is similar to the decking members disclosed in Schmidtke U.S. Pat. No. 4,792,325, the disclosure of which is incorporated herein by reference.

Because of its trapezoidal cross-section, each of the decking members 90 has a relatively wide, substantially planar, upper edge 94 and a relatively narrow, substantially planar, lower edge 96. When the decking members 90 are secured adhesively to the stringers 12, 14, the lower edges 96 of the decking members 90 are substantially coplanar.

The outer stringers 14, the braces 16, and the decking members 90 are assembled so that the upper panel 50 of each brace 16 is adjacent to the generally planar lower edge 96 of a selected one of the decking members 90. Preferably, the upper panel 50 of each brace 16 is adjacent to the generally planar lower edge 96 of the decking member 90 nearest to one end of each of the stringers 12, 14, as shown. The upper panel 50 of each brace 16 secured adhesively to the generally planar lower edge 96 of the selected one of the decking members 90.

As described so far, the pallet 10 is similar in numerous respects to a pallet disclosed in U.S. patent application Ser. No. 08/201,345, supra. However, the pallet 10 is improved over the pallet disclosed therein in important respects, as described below.

Figure 2:
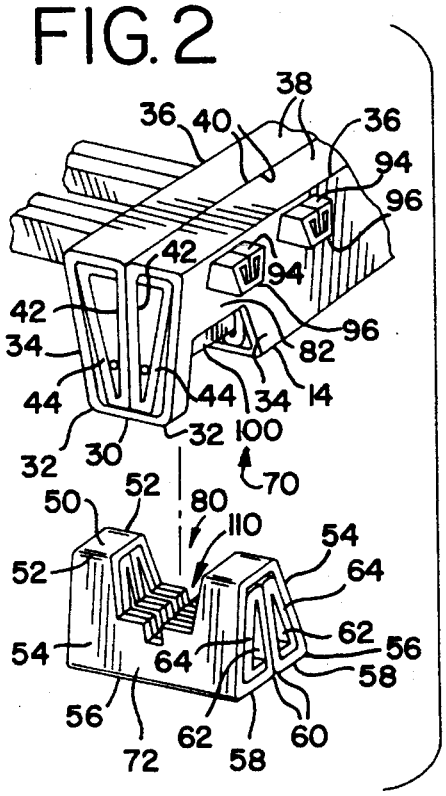
FIG. 2, on a slightly enlarged scale, is an exploded, fragmentary detail of the pallet.
Figure 2A:
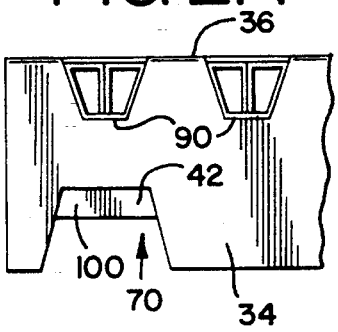
FIG. 2A is a fragmentary, elevational view of the stringer and decking members of the pallet, as shown in FIG. 2.
Figure 3:
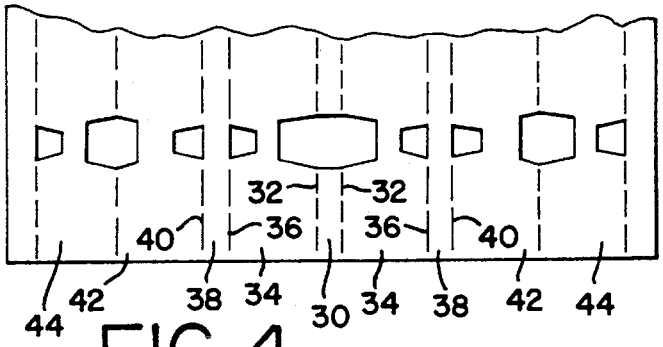
FIG. 3 is a fragmentary, plan view of a paperboard blank, from which one of the stringers is folded.
Figure 4:
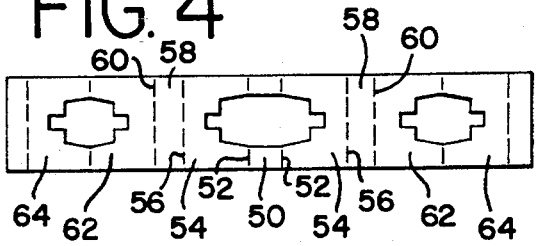
FIG. 4 is a fragmentary, plan view of a paperboard blank, from which one of the braces is folded.

In each of the stringers 12, 14, each notch 70 is shaped so as to be shallower at the inner panels 42 thereof, and so as to be deeper at the other generally upright panels thereof, namely the outer panels 34 thereof and the inner panels 44. Thus, as shown in FIG. 2, a web 100 formed of lower portions of the inner panels 42 thereof extends into such notch 70. The webs 100 strengthen and reinforce the stringers 12, 14, at the notches 70.

In each brace 16, the notch 80 is shaped so as to have a groove 110 extending across the generally upright panels 54, 62, and 64 of such brace 16. The groove 100 receives the web 100 extending into the stringer notch 70 interengaged with the notch 80 having the groove 110.

As compared to the pallets disclosed in U.S. patent application Ser. No. 08/074,942, supra, and in U.S. patent application Ser. No. 08/201,345, supra, the pallet 10 provides significant advantages. The webs 100 extending into the grooves 100 lend improved lateral stability to the outer stringers 14 and to the pallet 10. Because the webs 100 are smooth-faced on their opposite sides, adhesive securement of the outer stringers 14 and the braces 16 at the interengaged notches 70, 80, is improved. Further, because the webs 100 strengthen the middle stringer 12 at its notches 70, the load-carrying capacity of the pallet 10 at the notches 70 of the middle stringer 12 is improved.

In an alternative embodiment (not shown) contemplated by this invention, two more braces 16 are employed, each having an upwardly opening notch 80 interengaged with one of the downwardly opening notches 70 of the middle stringer 12.

In another alternative embodiment (not shown) contemplated by this invention, the pallet 10 may have an upper sheet and a lower sheet, as disclosed in U.S. patent application Ser. No. 08/074,942, supra.

Various modifications may be made in the preferred embodiment described above without departing from the scope and spirit of this invention.

We claim:

1. A pallet comprising a longitudinally extending stringer folded from a single sheet of paperboard material and a transversely extending brace folded from a single sheet of paperboard material, the stringer being folded so as to have a lower panel having two outer edges, so as to have generally upright panels including two outer panels, each extending upwardly from one of the outer edges of the lower panel and each having an upper edge, so as to have two upper panels, each extending inwardly from the upper edge of one of the outer panels and each having an inner edge, and so as to have two inner panels secured adhesively to one another, each extending downwardly from the inner edge of one of the upper panels, approximately to the lower panel, the brace being folded so as to have an upper panel having two outer edges, so as to have two outer panels, each extending downwardly from one of the outer edges of the lower panel and each having a lower edge, so as to have two lower panels, each extending inwardly from a lower edge of one of the outer panels, and so as to have two inner panels adjacent to each other, each extending upwardly from am edge of one of the lower panels, approximately to the upper panel, the stringer having a downwardly opening notch receiving a portion of the brace and the brace having an upwardly opening notch receiving a portion of the stringer, the downwardly and upwardly opening notches interengaging with each other, wherein a notch selected from the downwardly and upwardly opening notches is shaped so as to be shallower at the inner panels of whichever of the stringer and the brace has the selected notch, so as to be deeper at the other generally upright panels of whichever of the stringer and the brace has the selected notch, and so as to have a web extending into the selected notch where shallower, the web being formed from the inner panels of whichever of the stringer and the brace has the selected notch, wherein the other of the downwardly and upwardly opening notches is shaped so as to interengage with the selected notch and so as to have a groove receiving the web extending into the selected notch, and wherein the stringer and the brace are secured adhesively to each other at the interengaging notches.

2. The pallet of claim 1 wherein wherein the web received by the groove is secured adhesively, along and within the groove, to the member having the notch with the groove.

3. The pallet of claim 2 wherein the stringer has the selected notch and the brace has the other notch.

4. The pallet of claim 3 wherein the stringer is one of a plurality of similar stringers of the pallet and wherein at least one of the stringers has at least one such downwardly opening notch that is not interengaged with the upwardly opening notch of such a brace.

5. The pallet of claim 4 wherein the brace is one of a plurality of similar braces of the pallet and wherein the upwardly opening notch of each brace is interengaged with one of the downwardly opening notches of the outer stringers.

6. The pallet of claim 5 wherein the stringer is one of three similar stringers of the pallet, namely two outer stringers and a middle stringer, wherein each of the outer and middle stringers has two such downwardly opening notches spaced longitudinally from each other, wherein the brace is one of four similar braces of the pallet, wherein the upwardly opening notch of each brace is interengaged with one of the downwardly opening notches of the outer stringers, and wherein each of the downwardly opening notches of the middle stringer is not interengaged with the upwardly opening notch of such a brace.

7. The pallet of claim 5 wherein each brace is folded so as to have a smaller cross-section, as compared to the cross-section of each stringer, and wherein the lower panels of the stringers and the lower panels of the braces are coplanar.

8. The pallet of claim 7 wherein the pallet further comprises a plurality of decking members extending transversely through apertures in the stringers, each decking member having a lower edge, and wherein the upper panel of each brace is adjacent to the lower edge of one of the decking members.

9. The pallet of claim 8 wherein the lower edge of each decking member is planar and wherein the upper panel of each brace is secured adhesively to the lower edge of one of the decking members.

* * * * *